US006217136B1

(12) United States Patent
Dorfman et al.

(10) Patent No.: US 6,217,136 B1
(45) Date of Patent: Apr. 17, 2001

(54) RETAINER AND SUPPORT DEVICE FOR FOOD ITEM

(75) Inventors: Alan Dorfman, Upper Holland; Michael Kind, Maple Glen, both of PA (US)

(73) Assignee: Basic Fun, Inc., Southampton, PA (US)

( * ) Notice: Subject to any disclaimer, the term of this patent is extended or adjusted under 35 U.S.C. 154(b) by 0 days.

(21) Appl. No.: 09/500,566

(22) Filed: Feb. 10, 2000

(51) Int. Cl.[7] ..... A47F 3/10
(52) U.S. Cl. ..... 312/135; 312/284; 220/252
(58) Field of Search ..... 312/114, 135, 312/284, 285, 293.2, 319.5, 319.7; 220/200, 244, 252, 377

(56) References Cited

U.S. PATENT DOCUMENTS 2,214,993 * 9/1940 De Witt ..... 312/285 X
3,652,142 * 3/1972 Kreutweiser ..... 312/284 X
4,632,474 * 12/1986 Ingersoll ..... 312/135 X
4,934,527 * 6/1990 Ho ..... 312/284 X
5,487,600 * 1/1996 Griffin ..... 312/135

OTHER PUBLICATIONS

Catalog Page, "Basic Fun Catogue", No Date Given.

* cited by examiner

*Primary Examiner*—James O. Hansen
(74) *Attorney, Agent, or Firm*—Caesar, Rivise, Bernstein, Cohen & Pokotilow, Ltd.

(57) ABSTRACT

A retainer and support device for a food item, e.g., a jawbreaker, includes a housing having a recessed wall defining a chamber for receiving the food item. A passageway extends through the recessed wall and a product engaging member extends through the passageway and into the chamber for engaging the surface of a food item retained in the chamber. A manually actuatable drive member is in driving communication with the product engaging member to move the product engaging member and thereby move the food item retained within the chamber.

9 Claims, 2 Drawing Sheets

FIG. 3
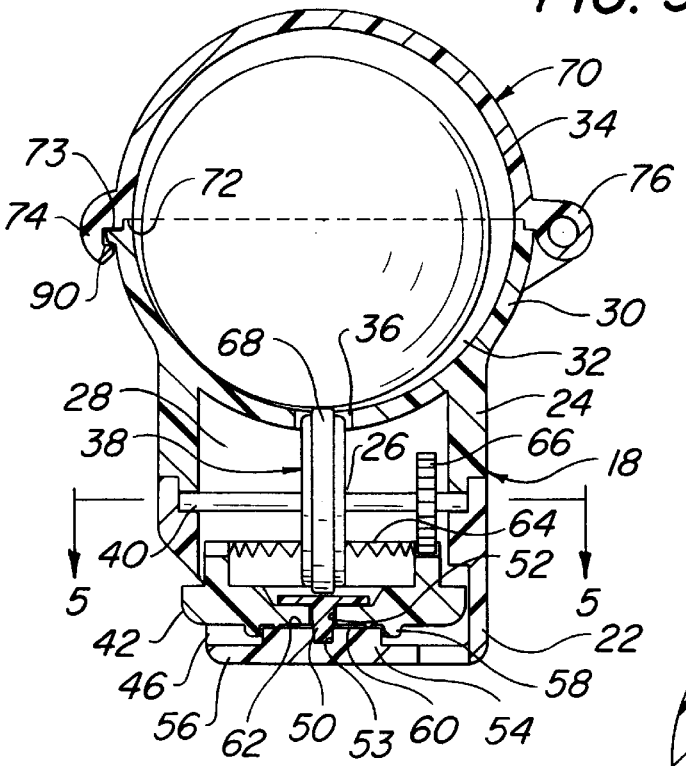
FIG. 5
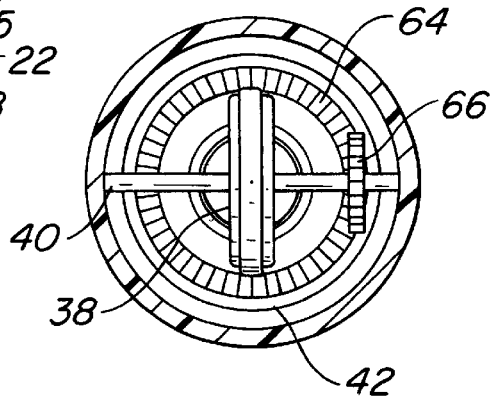
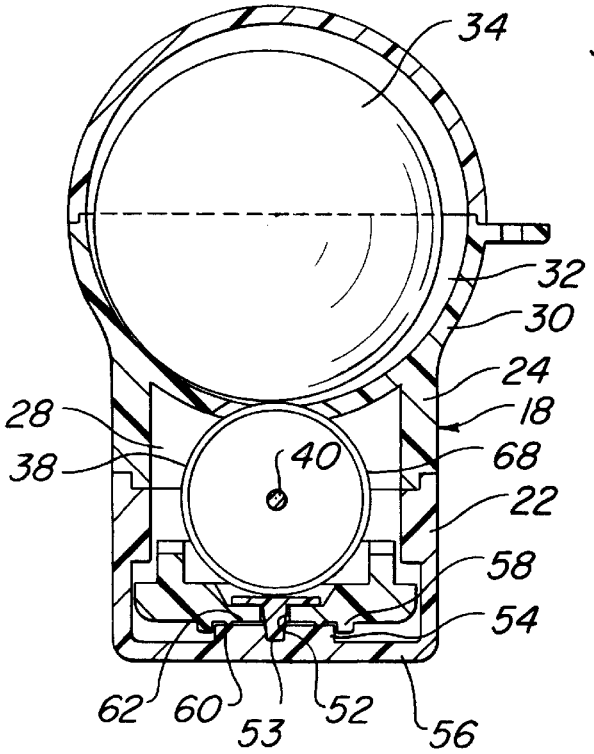
FIG. 4

RETAINER AND SUPPORT DEVICE FOR FOOD ITEM

FIELD OF INVENTION

This invention relates generally to a retainer and support device for a food item, and more specifically to a retainer and support device for a spherical food item, such as a jawbreaker.

BACKGROUND OF THE INVENTION

It is known to provide a holder for a lollipop, which is designed to grip the lollipop stick and rotate the stick about its axis as a person licks the surface of the lollipop. This device relies upon the provision of a supporting stick for the lollipop to make the device operable.

A need is believed to exist for a retainer and support device that is capable of supporting and rotating a food item that is not mounted on a stick (e.g., a jawbreaker) while permitting a person to lick the surface of the food item. In addition, it is desirable to provide such a retaining and support device that permits the food item to be easily removed therefrom and placed in a person's mouth, if desired, and thereafter stored in the retainer and support device for future use, either by licking the surface of the food item while it is being rotated within the support device, or by again removing the food item from the device and placing it in the person's mouth. It is to a retainer and support device of this latter mentioned type that this invention is directed.

SUMMARY OF THE INVENTION

The above and other objects of this invention are achieved in a retainer and support device for a food item including a housing having a recessed wall therein to provide a chamber for receiving a food item, such as a jawbreaker therein. A passageway, or opening, is provided in the recessed wall, most preferably at the bottom thereof, and a product engaging member extends through the passageway to engage and move a food item positioned within the chamber. A manually actuatable drive member cooperates with the product engaging member to drive the product engaging member and thereby move, e.g., rotate, a food item, such as a jawbreaker, retained in the chamber.

In a preferred embodiment, a dome or lid is moveably secured to the housing between a closed position for closing the chamber and an opened position for permitting access to the chamber. Most preferably the dome or lid is made of a clear plastic material so that a food item, such as a jawbreaker, positioned within the chamber can be visually seen by the user. A latching member is provided to retain the dome or lid in a closed position, and this latching member can be manually defeated to thereby permit the dome or lid to be opened manually, as desired.

In the preferred embodiments of this invention the retainer and support device can be carried in a person's pocket or purse, and can be attached, through a conventional chain, to a person's key or key ring.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 3 is a sectional view taken along 3—3 of FIG. 1;

FIG. 4 is a sectional view taken along 4—4 of FIG. 2; and

FIG. 5 is a sectional view taken along line 5—5 of FIG. 3.

DESCRIPTION OF THE PREFERRED EMBODIMENTS OF THE INVENTION

Figure 1:
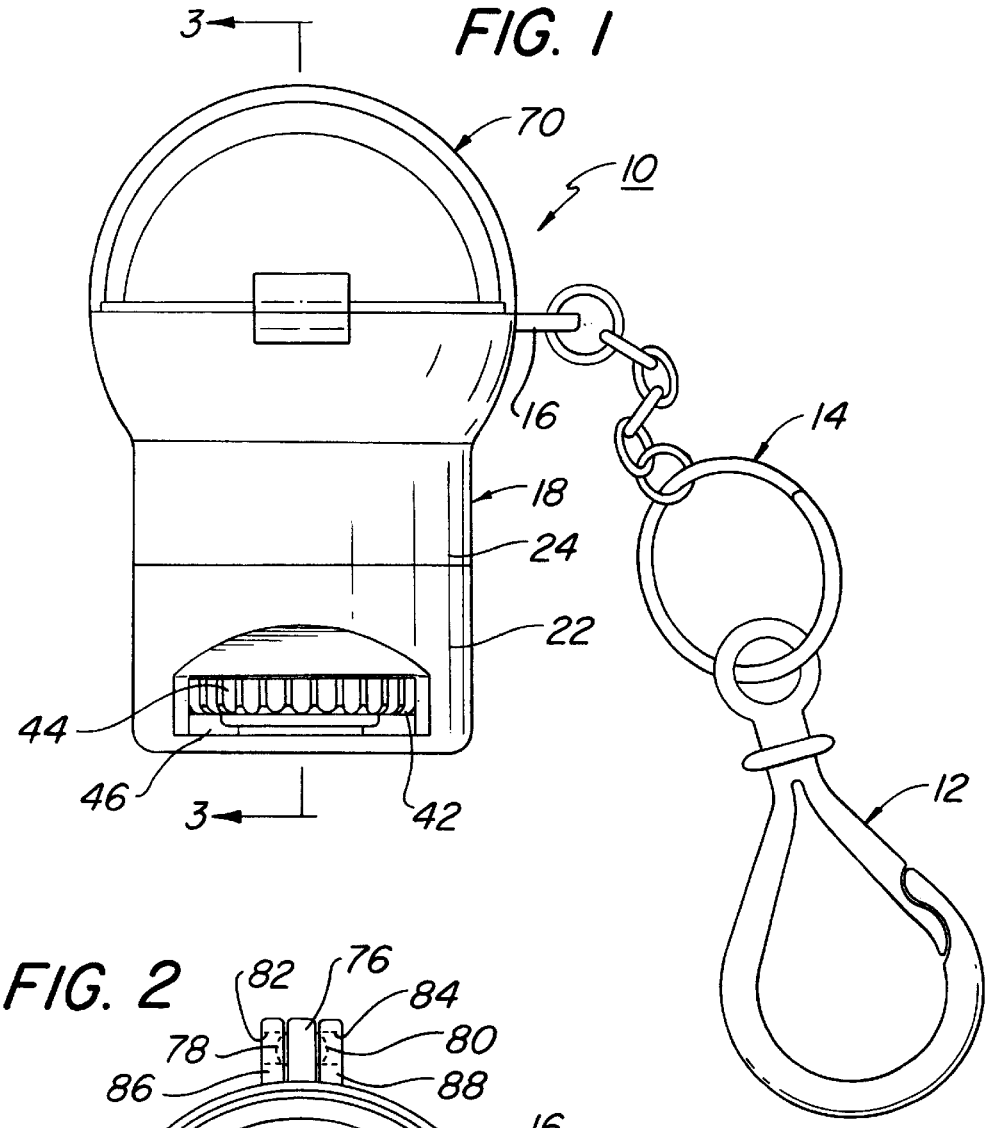
FIG. 1 is a front elevational view of the retainer and support device in accordance with this invention.

Referring now in greater detail to the various figures of the drawing wherein like reference characters refer to like parts, a retainer and support device for a food item constructed in accordance with the present invention is shown generally at 10 in FIG. 1. As illustrated, the retainer and support device 10 is attached to a key ring 12 through a linkage system 14. The linkage system 14 is attached to a connecting member 16, in the form of an islet integrally molded as part of housing 18, which is made of a suitable, moldable plastic material. In the preferred embodiment of the invention the plastic is an approved material of the Food and Drug Administration, such as a food grade acrylonitrile-butadiene acrylate (ABA). In fact, all of the plastic parts of this invention are molded of a food grade ABA material, except for lid 20, which is made of a K-resin.

Referring to FIGS. 1, 3 and 4, the housing 18 includes a lower housing section 22 and an upper housing section 24; each molded as a separate unit. A drive system 26 is mounted in a lower housing compartment 28 of the lower housing section 22 prior to the upper housing section 24 being adhered to the lower housing section by a suitable bonding agent.

As can be seen best in FIGS. 3 and 4, the upper housing section 24 includes a concave, recessed wall 30 defining a hemispherical chamber 32 for receiving a food item, such as jawbreaker 34 therein. A passageway 36 is provided through the recessed wall 30; preferably at the bottom of the hemispherical curve, for receiving an arcuate portion of a product engaging driven member 38 therein. The product engaging, driven member 38 is in the form of a wheel secured for rotational movement to a rotatably mounted axle 40.

Referring to FIGS. 1 and 2–4, a manually actuatable drive member 42 is in the form of a horizontally rotatable wheel having a knurled peripheral surface 44 extending through passage 46 in a wall section of the lower housing section 22 (FIG. 1). The drive member is rotatably mounted about a plastic axle 50 secured within passages 52, 53 of the drive member and raised, central hub section 54 of bottom wall 56 of the lower housing section 22, respectively. To assist in maintaining the drive member 42 in a proper position it is provided with a downwardly extending annular flange 58 closely overlying the peripheral side wall of the central hub section 54. As can be seen best in FIGS. 3 and 4, a downwardly extending rib 60, having a low friction knife edge, rotatably engages upper surface 62 of the hub section 54 as the drive wheel 42 is manually rotated.

Referring to FIGS. 3 and 5, the horizontally rotatable wheel 42 includes an upwardly directed annular gear 64 that engages the drives vertically oriented driven gear 66 fixedly secured to the rotatably mounted axle 40. Thus, manual rotation of the wheel 42 causes rotational motion of the axle 40, and the product engaging driven member 38 affixed thereto, through the cooperation of the annular gear 64 with the vertically oriented driven gear 66.

Referring to FIGS. 3 through 5, an annular rubber member, or ring, 68 is secured to the outer periphery of the driven wheel 38 and extends through the passageway 36 of the recessed wall 30 to frictionally engage the outer periphery of the jawbreaker 34, or other food item retained within the hemispherical chamber 32 of the upper housing section 24, to thereby rotate said jawbreaker within the chamber. In use, a person can lick the jawbreaker as it is being rotated. Alternatively, a person can pop the jawbreaker into his mouth to suck it, and can then return the jawbreaker to the hemispherical chamber 32, when desired.

Figure 2:
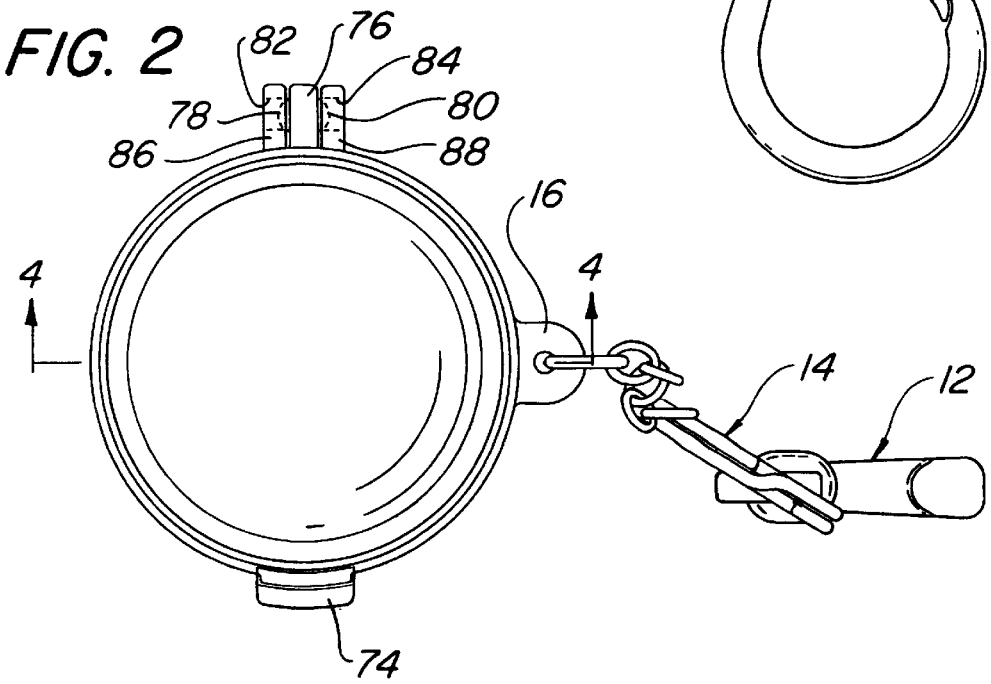
FIG. 2 is a plan view of the retainer and support device shown in FIG. 1.

Referring to FIGS. 1 through 3, a lid 70, preferably molded of a clear plastic material, is in the form of an upper hemispherical dome having a lower, stepped edge surface 72 for engaging with an upper stepped surface 73 constituting the upper edge of the hemispherical chamber 32, to thereby provide a closed compartment for the food item retained within said chamber.

The lid 70 includes an integrally molded front locking flange member 74 and a diametrically opposed, rear projecting member 76. The rear projecting member 76 includes transversely extending, generally curved projections 78, 80 that are rotatably received within aligned passages 82, 84 of transversely spaced apart, lid supporting projections 86, 88, respectively. This latter arrangement permits rotational movement of the lid 70 between an opened position to permit access to the interior chamber 32, and a closed position, as shown in FIGS. 1, 3 and 4, to close the interior chamber. In this latter closed position the front locking flange member 74 of the lid is snapped over an outwardly projecting lip 90 (FIG. 3) integrally molded with the upper housing section 24 to thereby maintain the lid 70 in a closed position. The lid 70 is sufficiently flexible to permit the engagement of the locking flange member 74 with the lip 90 to be manually defeated, to thereby permit the lid to be moved into an opened position when desired.

As is illustrated in the preferred embodiment, the food retainer and support device 10 is shown as an attachment to a key chain. However, it should be understood that the device 10 can be employed as a free standing unit, or can be included or attached to other articles, as defined. Also, although the device 10 preferably is molded of food-grade plastic materials, the particular materials used to form the device 10 do not constitute a limitation on the broadest aspects of this invention.

Without further elaboration, the foregoing will so fully illustrate my invention that others may, by applying current or future knowledge, readily adapt the same for use under various conditions of service.

What we claim as the invention is the following:

1. A retainer and support device for a food item including a housing, said housing having a recessed wall, said recessed wall having an outer surface defining a chamber dimensioned for receiving a food item, said recessed wall being interrupted to provide a passageway therethrough, a product engaging member having a product engaging surface extending through the passageway in the recessed wall and extending beyond the outer surface of the recessed wall into the chamber for engaging a surface of a food item retained in said chamber, a manually actuatable drive member in driving communication with the product engaging member to move the product engaging member and cause the product engaging surface of said product engaging member to move in engagement with the surface of the food item to thereby move the food item retained within the chamber relative to the outer surface of said recessed wall.

2. The retainer and support device of claim 1, wherein said chamber is substantially hemispherical and is designed for receiving a substantially spherical food item therein, said product engaging member being a rotating wheel and said product engaging surface being a peripheral surface of said wheel extending through the passageway and adapted to engage the surface of a spherical food item placed within the chamber, said product engaging wheel upon being driven by the manually actuatable drive member rotating the spherical food item placed within said chamber.

3. The retainer and support device of claim 2, wherein said drive member is geared to the wheel in a manner that transmits rotational movement of the drive member within a first plane into rotational movement of the wheel in a second plane.

4. The retainer and support device of claim 2, wherein said recessed wall is interrupted in a lower segment thereof for providing the passageway therethrough.

5. The retainer and support device of claim 1, wherein said chamber is dimensioned for receiving a spherical food item and said product engaging surface is an outer surface of a frictional ring member forming part of the product engaging member for frictionally engaging the surface of a spherical food item placed within the chamber.

6. The retainer and support device of claim 1, further including a lid movably secured to the housing and moveable between a closed position overlying the chamber to retain a food item therein, and an opened position to permit access to the food item within the chamber.

7. The retainer and support device of claim 6, wherein said lid is a clear plastic member.

8. The retainer and support device of claim 7, wherein said lid is in the form of a hemispherical dome, whereby said lid, when in a closed position, cooperates with the chamber to provide a closed spherical compartment for retaining a food item therein.

9. The retainer and support device of claim 1, including a connecting member projecting from the housing for receiving a fastener for a key or key ring.

* * * * *